US005904578A

United States Patent [19]

Kubota et al.

[11] Patent Number: 5,904,578

[45] Date of Patent: May 18, 1999

[54] COAXIAL RECEPTACLE CONNECTOR HAVING A CONNECTION DETECTING ELEMENT

[75] Inventors: Yoshifumi Kubota; Hideyuki Ohtani; Osamu Takagi, all of Tokyo, Japan

[73] Assignee: Japan Aviation Electronics Industry, Limited, Tokyo, Japan

[21] Appl. No.: 08/869,548

[22] Filed: Jun. 5, 1997

[51] Int. Cl.[6] ..... H01R 9/09

[52] U.S. Cl. ..... 439/63; 439/489

[58] Field of Search ..... 439/63, 489, 581, 439/675

[56] References Cited

FOREIGN PATENT DOCUMENTS 6-223924 8/1994 Japan .

*Primary Examiner*—Neil Abrams
*Assistant Examiner*—Antoine Ngandjui
*Attorney, Agent, or Firm*—Laff, Whitesel, Conte & Saret, Ltd.

[57] ABSTRACT

In a coaxial receptacle connector for receiving an coaxial plug connector having a plug side central contact and a plug side outer contact surrounding the plug side central contact, a receptacle side outer contact and a connection detecting element are placed around a receptacle side central contact to form a substantially cylindrical portion in cooperation with each other with gaps left therebetween in a circumferential direction. The receptacle side central contact is for being brought in contact with the plug side central contact. The receptacle side outer contact is for being brought into contact with the plug side central contact. The connection detecting element for detecting a connection between the coaxial plug connector and the coaxial receptacle connector.

5 Claims, 3 Drawing Sheets

COAXIAL RECEPTACLE CONNECTOR HAVING A CONNECTION DETECTING ELEMENT

BACKGROUND OF THE INVENTION

This invention relates to a coaxial receptacle connector having a function for detecting a connection of a coaxial plug connector.

Such a conventional coaxial receptacle connector is disclosed in Japanese Patent Prepublication No. 223924/1994. The conventional coaxial receptacle connector comprises a first and a second connection detecting element which are driven by a coaxial plug connector connected to the coaxial receptacle connector. The first connection detecting element is in contact with the second connection detecting element when the coaxial plug connector is not connected to the coaxial receptacle connector. When the coaxial plug connector is connected to the coaxial receptacle connector, the first connection detecting element is separated from the second connection detecting element. Thus, it is possible to detect whether or not the coaxial plug connector is connected to the coaxial receptacle connector.

In the conventional coaxial receptacle connector, however, the first and the second connection detecting elements do not cause a wiping action therebetween known in the art. Accordingly, it is apt to make contact failure between the first and the second connection detecting elements.

SUMMARY OF THE INVENTION

It is therefore an object of this invention to provide a coaxial receptacle connector having a connection detecting element which causes wiping action on the occasion of a connection or a disconnection of the connector.

It is another object of this invention to provide a coaxial receptacle connector of the type described, which is prevented from contact failure of the connection detection element.

Other objects of this invention will become clear as the description proceeds.

According to this invention, there is provided a coaxial receptacle connector for receiving an coaxial plug connector having a plug side central contact and a plug side outer contact surrounding the plug side central contact. The coaxial receptacle connector comprises a receptacle side central contact for being brought in contact with the plug side central contact, a receptacle side outer contact for being brought in contact with the plug side central contact, a connection detecting element for detecting a connection between the coaxial plug connector and the coaxial receptacle connectors, and an insulator holding the receptacle side central contact, the receptacle side outer contact, and the connection detecting element and insulating them from one another. The coaxial receptacle connector has a connection end portion which is for electrically connecting the coaxial plug connector and in which the receptacle side outer contact and the connection detecting element are placed around the receptacle side central contact to form a substantially cylindrical portion in cooperation with each other with gaps left therebetween in a circumferential direction of the substantially cylindrical portion. The substantially cylindrical portion is closely fitted into the plug side outer contact.

DESCRIPTION OF THE PREFERRED EMBODIMENT

Figure 1:
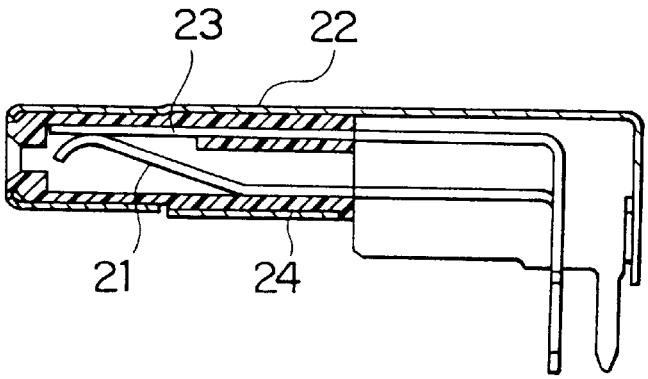
FIG. 1 PRIOR ART
FIG. 1 is a longitudinal sectional view of a conventional coaxial receptacle connector.
Figure 2:
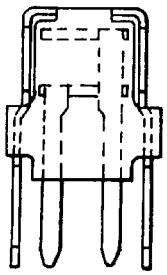
FIG. 2 PRIOR ART
FIG. 2 is a right side view of the conventional coaxial receptacle connector of FIG. 1.
Figure 3:
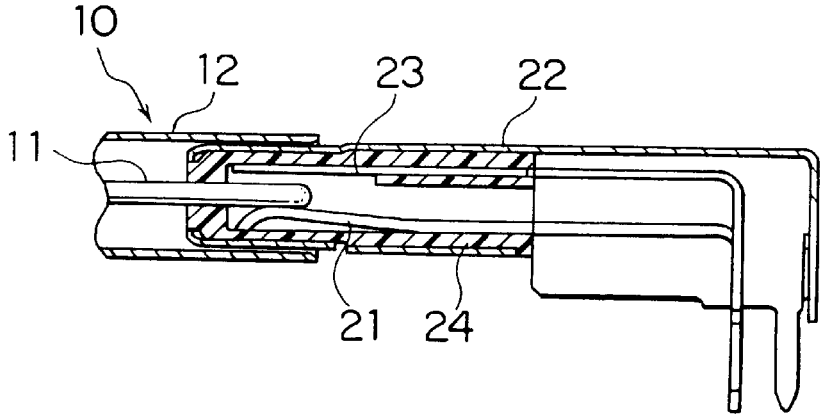
FIG. 3 PRIOR ART
FIG. 3 is a longitudinal sectional view of the conventional coaxial receptacle connector of FIG. 1 with a coaxial plug connector being connected thereto.
Figure 4:
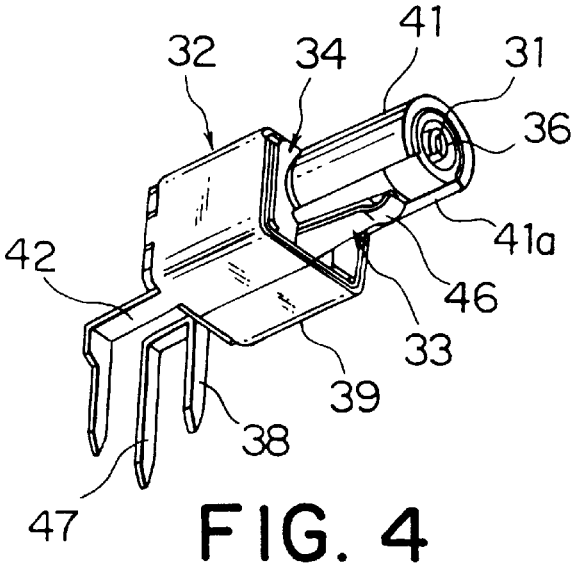
FIG. 4 is a perspective view of a coaxial receptacle connector according to an embodiment of this invention.
Figure 5:
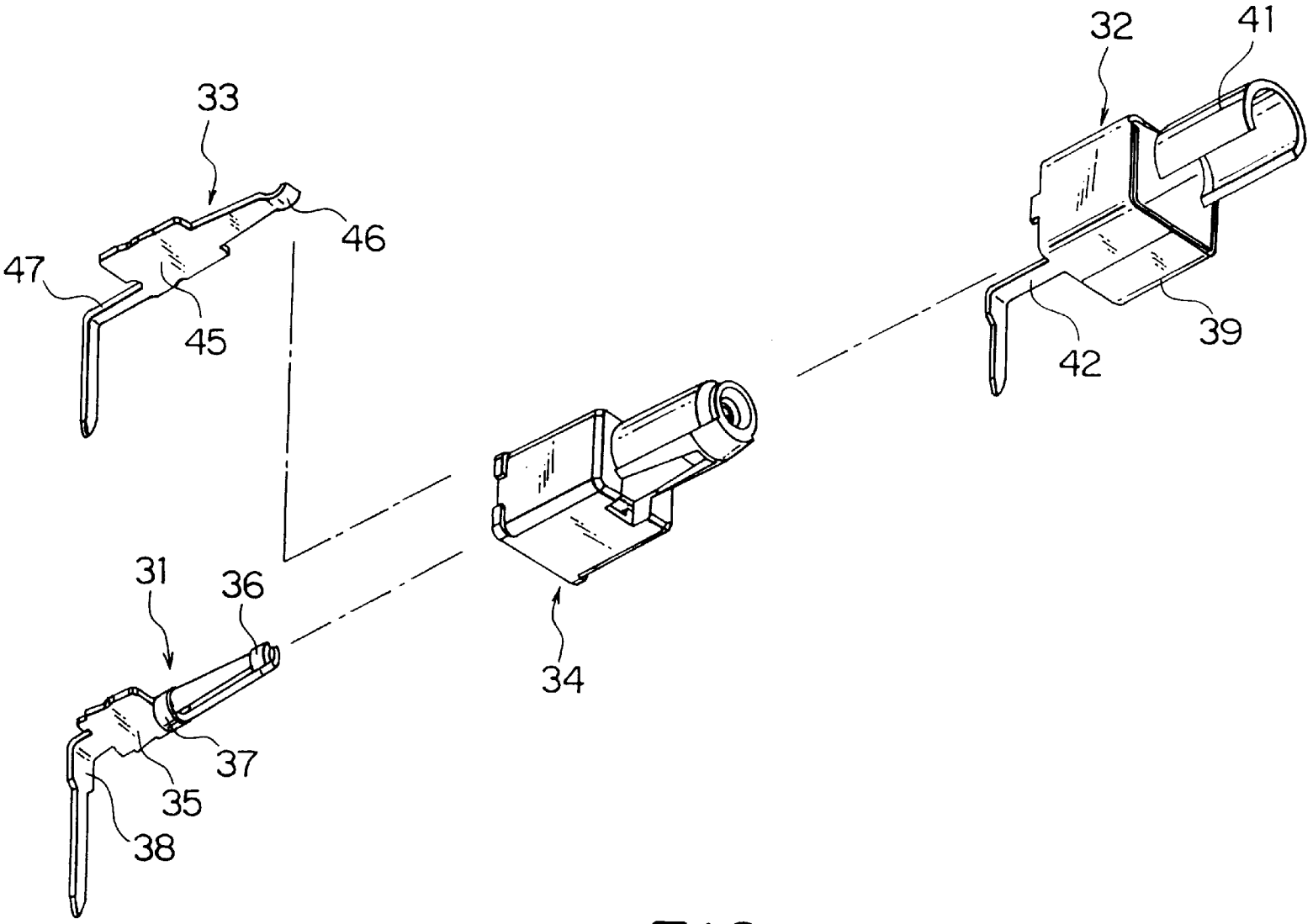
FIG. 5 is an exploded perspective view of the coaxial receptacle connector of FIG. 4.
Figure 6:
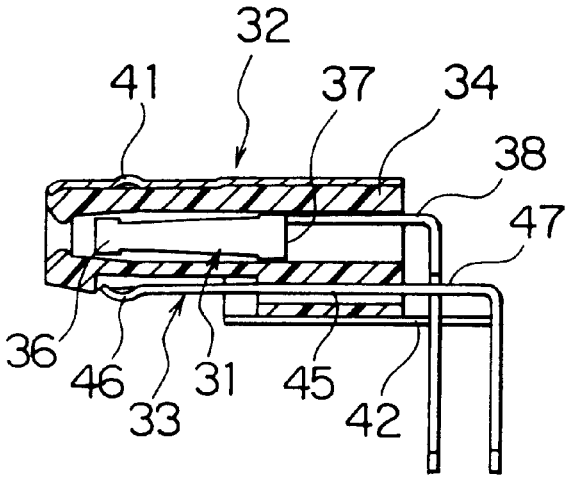
FIG. 6 is a longitudinal sectional view of the coaxial receptacle connector of FIG. 4.
Figure 7:
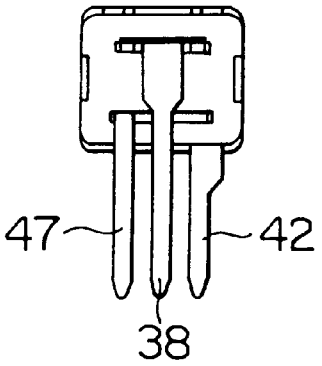
FIG. 7 is a right side view of the coaxial receptacle connector of FIG. 4.

Referring to FIGS. 1 through 3, description will at first be made as regards a conventional coaxial receptacle connector for a better understanding of this invention.

The coaxial receptacle connector is for receiving an coaxial plug connector 10 having a plug side central contact 11 and and a plug side outer contact 12 surrounding the plug side central contact 11. Each of the plug side central and the plug side outer contacts 11 and 12 is conductive. The plug side outer contact 12 is cylindrical.

The coaxial receptacle connector comprises a receptacle side central contact 21, a receptacle side outer contact 22, a connection detecting element 23, and an insulator 24. Each of the receptacle side central contact 21, the receptacle side outer contact 22, and the connection detecting element 23 is conductive. The insulator 24 holds the receptacle side central contact 21, the receptacle side outer contact 22, and the connection detecting element 23.

The receptacle side outer contact 22 is cylindrical and is adapted to closely fit into the plug side outer contact 12. The receptacle side central contact 21 is made of a spring member and is in press contact with the connection detecting element 23 when the coaxial receptacle connector is not connected to the coaxial plug connector 10.

When the coaxial receptacle connector is connected to the coaxial plug connector 10 as illustrated in FIG. 3, the plug side central contact 11 engages with the receptacle side central contact 21 to separate the receptacle side central contact 21 from the connection detecting element 23. In this event, the plug side outer contact 12 is closely fitted over the receptacle side outer contact 22.

Next referring to FIGS. 4 through 8. the description is made as regards a coaxial receptacle connector according to an embodiment of this invention. Similar parts are designated by like reference numerals.

The coaxial receptacle connector also is for receiving an coaxial plug connector 10 and comprises a receptacle side central contact 31, a receptacle side outer contact 32, a connection detecting element 33, and an insulator 34. Each of the receptacle side central contact 31, the receptacle side outer contact 32, and the connection detecting element 33 is made of a conductive member. The insulator 33 holds the receptacle side central contact 31, the receptacle side outer contact 32, and the connection detecting element 33.

The receptacle side central contact 31 comprises a pair of contact pieces 36 opposite to each other in a radial direction, a connecting portion 37 connecting the contact pieces each other, and a plate-shape portion 35 formed integral with the connecting portion 37 and held to the insulator 34. A connecting leg portion 38 extends rearwardly from the connecting portion 37 in an axial direction perpendicular to the radial direction. The connecting leg portion 38 is bent to extend in the radial direction.

The receptacle side outer contact 32 comprises a shielding portion 39 and a contact portion 41 is formed integral with the shielding portion 39. The shielding portion 39 surrounds the insulator 34 and is held thereto. The contact portion 41 cylindrically extends in a circumferential direction to have ends defining a predetermined space 41*a* therebetween. In other words, the contact portion 41 is rounded along a cylindrical shape around the receptacle side central contact 31 to leave the predetermined space 41*a*. The contact portion 41 has a size which is adapted to closely fit into the plug side outer contact 12. A connecting leg portion 42 extends rearwardly from the shielding portion 39 in the axial direction and then is bent to extend in the radial direction.

The connection detecting element 33 comprises a plate-shaped portion 45 held to the insulator 34 and a spring portion 46 extending from the plate-shaped portion 45 into the predetermined space 41 in the axial direction. The spring portion 46 is for being brought in press contact with the plug side outer contact 12 when the coaxial receptacle connector is connected to the coaxial plug connector 10. A connecting leg portion 47 extends rearwardly from the spring portion 46 in the axial direction and then is bent to extend in the radial direction. Each of the contacting leg portions 38, 42, and 47 is electrically connected to an electric circuit mounted on a circuit board (not shown) in the manner known in the art.

More particularly, the coaxial receptacle connector has a connection end portion which is for electrically connecting the coaxial plug connector 10 and in which the receptacle side outer contact 32 and the connection detecting element 33 forms a substantially cylindrical portion in cooperation with each other with gaps left therebetween in the circumferential direction. The insulator 33 is placed between the receptacle side central contact and the substantially cylindrical portion that is a combination of the receptacle side outer contact 32 and the connection detecting element 33.

Figure 8:
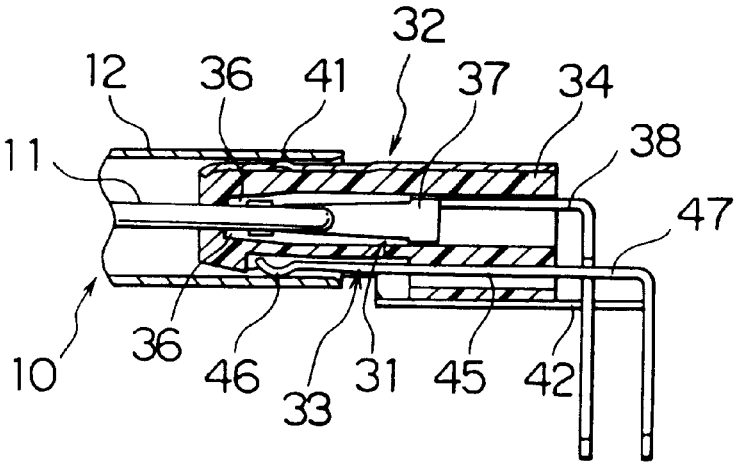
FIG. 8 is a longitudinal sectional view of the coaxial receptacle connector of FIG. 4 with a coaxial plug connector being connected thereto.

When the coaxial receptacle connector is connected to the coaxial plug connector 10 as illustrated in FIG. 8, the substantially cylindrical portion is closely fitted in the plug side outer contact 12. As a result, the spring portion 46 of the connection detecting element 33 is brought in press contact with an internal surface of the plug side outer contact 12 with being slid on the internal surface. Simultaneously, the contact portion 41 of the receptacle side outer contact 32 is brought in contact with the internal surface of the plug side outer contact 12, while the contact pieces 36 of the receptacle side center contact 31 are inserted with the plug side center contact 11 therebetween to become into contact with the plug side center contact 11.

With this structure, the connection detecting element 33 is electrically connected to the receptacle side outer contact 32 through the plug side outer contact 12 only when the coaxial plug connector 10 is connected to the coaxial receptacle connector. Therefore, it is possible to detect through the electric circuit on the circuit board about whether or not the coaxial plug connector 10 is connected to the coaxial receptacle connector.

The connection detecting element 33 is slid on the internal surface of the plug side outer contact 12 whenever the coaxial plug connector 10 is connected to or disconnected from the coaxial receptacle connector. This results in making the connection detecting element 33 and the plug side outer contact 12 have wiping action therebetween. Therefore, reliability becomes high as regards contact between the connection detecting element 33 and the plug side outer contact 12.

While the present invention has thus far been described in connection with a few embodiments thereof, it will readily be possible for those skilled in the art to put this invention into practice in various other manners. For example, the receptacle side outer contact may be provided with at least one spring portion which is brought in press contact with the inner surface of the plug side outer contact to serve as the contact portion when the coaxial receptacle connector is connected to the coaxial plug connector.

What is claimed is:

1. A coaxial receptacle connector for receiving an coaxial plug connector having a plug side central contact and a plug side outer contact surrounding said plug side central contact, said coaxial receptacle connector comprising:

a receptacle side central contact for being brought in contact with said plug side central contact;

a receptacle side outer contact for being brought in contact with said plug side outer contact;

a connection detecting element for detecting a connection between said coaxial plug connector and said coaxial receptacle connectors; and an insulator holding said receptacle side central contact, said receptacle side outer contact, and said connection detecting element and insulating them from one another, said coaxial receptacle connector having a connection end portion which is for electrically connecting said coaxial plug connector and in which said receptacle side outer contact and said connection detecting element are placed around said receptacle side central contact to form a substantially cylindrical portion in cooperation with each other with gaps left therebetween in a circumferential direction of said substantially cylindrical portion, said substantially cylindrical portion being closely fitted into said plug side outer contact.

2. A coaxial receptacle connector as claimed in claim 1, wherein said insulator is placed between said receptacle side central contact and said substantially cylindrical portion.

3. A coaxial receptacle connector as claimed in claim 1, wherein said plug side outer contact is cylindrical, said receptacle side outer contact having, at said connection end portion, a contact portion which cylindrically extends in said circumferential direction to have ends defining a predetermined space therebetween, said contact portion being adapted to closely fit into said plug side outer contact.

4. A coaxial receptacle connector as claimed in claim 3, wherein said connection detecting element has a spring portion which extends in said predetermined space for being brought in press contact with said plug side outer contact.

5. A coaxial receptacle connector as claimed in claim 3, wherein each of said receptacle side central contact, said receptacle side outer contact, and said connection detecting element has a connecting leg portion which extends opposite to said connection end portion in an axial direction and then is bent perpendicular to said axial direction.

* * * * *